US005265876A

United States Patent [19]

Moon

[11] Patent Number: 5,265,876

[45] Date of Patent: Nov. 30, 1993

[54] GOLF TRAINING DEVICE

[76] Inventor: Michael R. Moon, 4711 Tulip Tree, Buchanan, Mich. 49107

[21] Appl. No.: 8,597

[22] Filed: Jan. 25, 1993

[51] Int. Cl.[5] ..... A63B 69/36

[52] U.S. Cl. ..... 273/186.2; 273/191 R

[58] Field of Search ..... 273/186.1, 186.2, 186.3, 273/187.4, 191 R, 192

[56] References Cited

U.S. PATENT DOCUMENTS

| | | | |
|---|---|---|---|
| 3,429,571 | 2/1969 | Abel | 273/191 R X |
| 3,604,712 | 9/1971 | Lansing et al. | 273/191 R X |
| 3,848,873 | 11/1974 | Linning | 273/186.2 |
| 5,139,264 | 8/1992 | Wooten | 273/191 R |
| 5,150,901 | 9/1992 | Stawicki | 273/191 R X |
| 5,188,367 | 2/1993 | Gipe et al. | 273/191 A X |

*Primary Examiner*—George J. Marlo

[57] ABSTRACT

A golf training device which includes a free-standing frame and a telescoping shaft connected by swivels to the frame and to a golf club. The frame includes multiple connection points for the shaft to accomodate golfers of various physiques and angles of inclination of their respective swing planes. The frame may be collapsible and easily disassembled for storage. The shaft can change its length and can generate an audible signal of a change in length.

9 Claims, 9 Drawing Sheets

GOLF TRAINING DEVICE

SUMMARY OF THE INVENTION

This invention relates to golf swing training devices and will have application to a full-swing training device.

Swing consistency is the desired objective of virtually every golfer, amateur and professional alike. Many devices are marketed to golfers, purporting to aid them in learning to swing consistently and correctly. Some attempt to guide the golfer's club and hands into a single geometric plane, the backswing and the downswing sharing the same plane. Photographs of many champion golfers, however, show that the correct technique is to swing the club back in one plane, and down in another as the golfer's torso rotates and his weight is shifted towards the target.

"Muscle memory," or the nervous system's ability to learn to perform a motion repeatedly and identically, plays a crucial role in the golfer's ability to produce a successful, consistent swing. Many golfers struggle unsuccessfully for years to learn the proper swing. Few have ever been able to play consistently well without swinging "in the plane."

There are an infinite number of angles of inclination for a swing plane, but there is one best angle (within a certain tolerance) for each individual golfer, which is dictated by his physique. Some golfers are tall, some are short, and all the different body types and shapes will produce a unique ideal angle for the swing plane of each individual golfer.

The training device embodied by this invention allows each golfer to find, and learn to produce, his ideal swing. This invention includes a plurality of adjustment features which allow each individual golfer to swing in his ideal plane and have the best opportunity to produce a consistent, successful, repeating swing.

It is therefore an object of this invention to provide for a novel golf swing training device.

Another object is to provide a golf swing training device which is easy and quick to set up at various training locations, and is also easily collapsed for storage.

Another object is to provide for a golf swing training device which is economical.

Other objects will become apparent upon a reading of the following description.

BRIEF DESCRIPTION OF THE DRAWING

A preferred embodiment of the invention has been depicted for illustrative purposes only wherein.

DESCRIPTION OF THE PREFERRED EMBODIMENT

Figure 1:
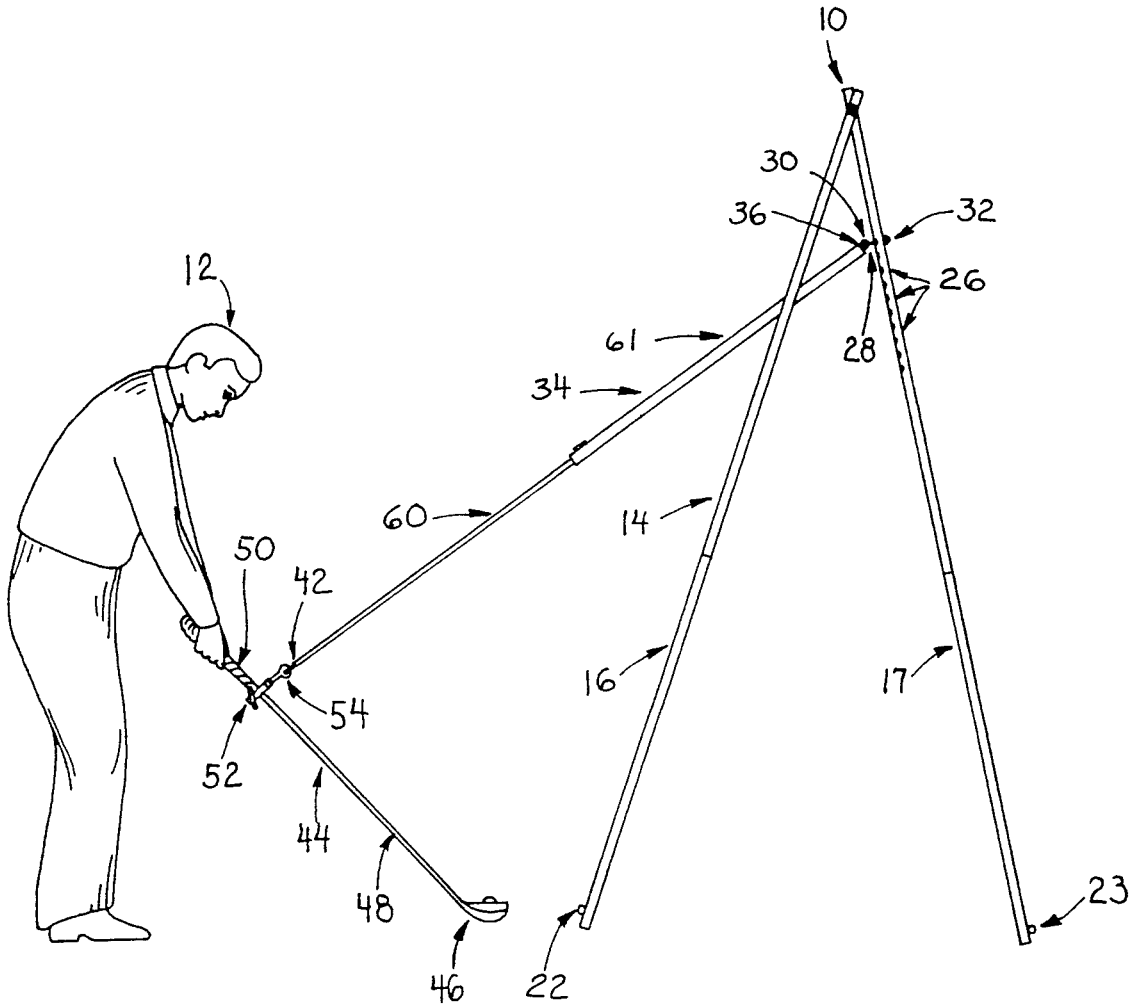
FIG. 1 is an elevation view of the golf swing training device in its set-up position.
Figure 2:
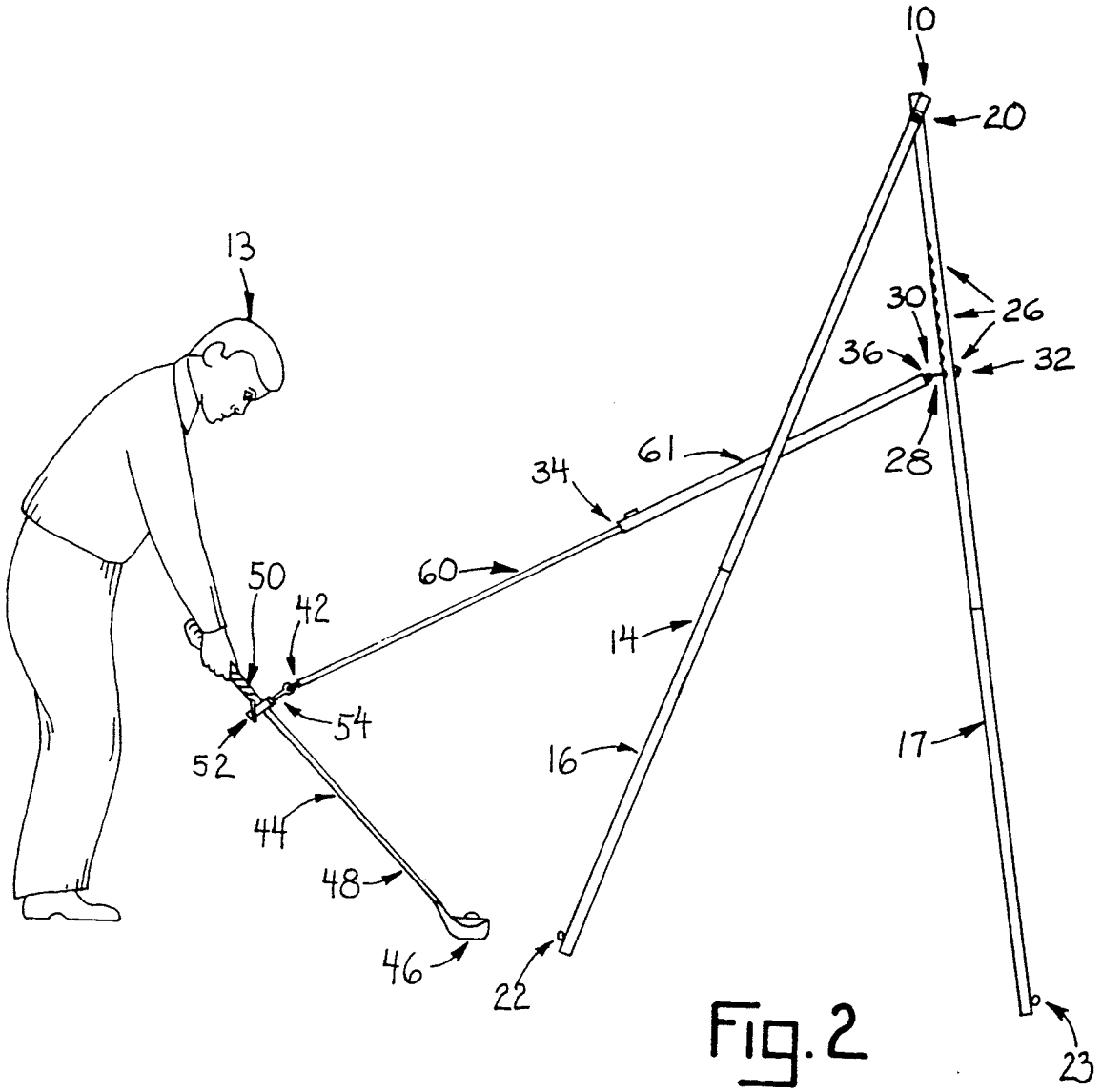
FIG. 2 is an elevation view of the device similar to FIG. 1 showing the adjustability feature of the shaft.
Figure 3:
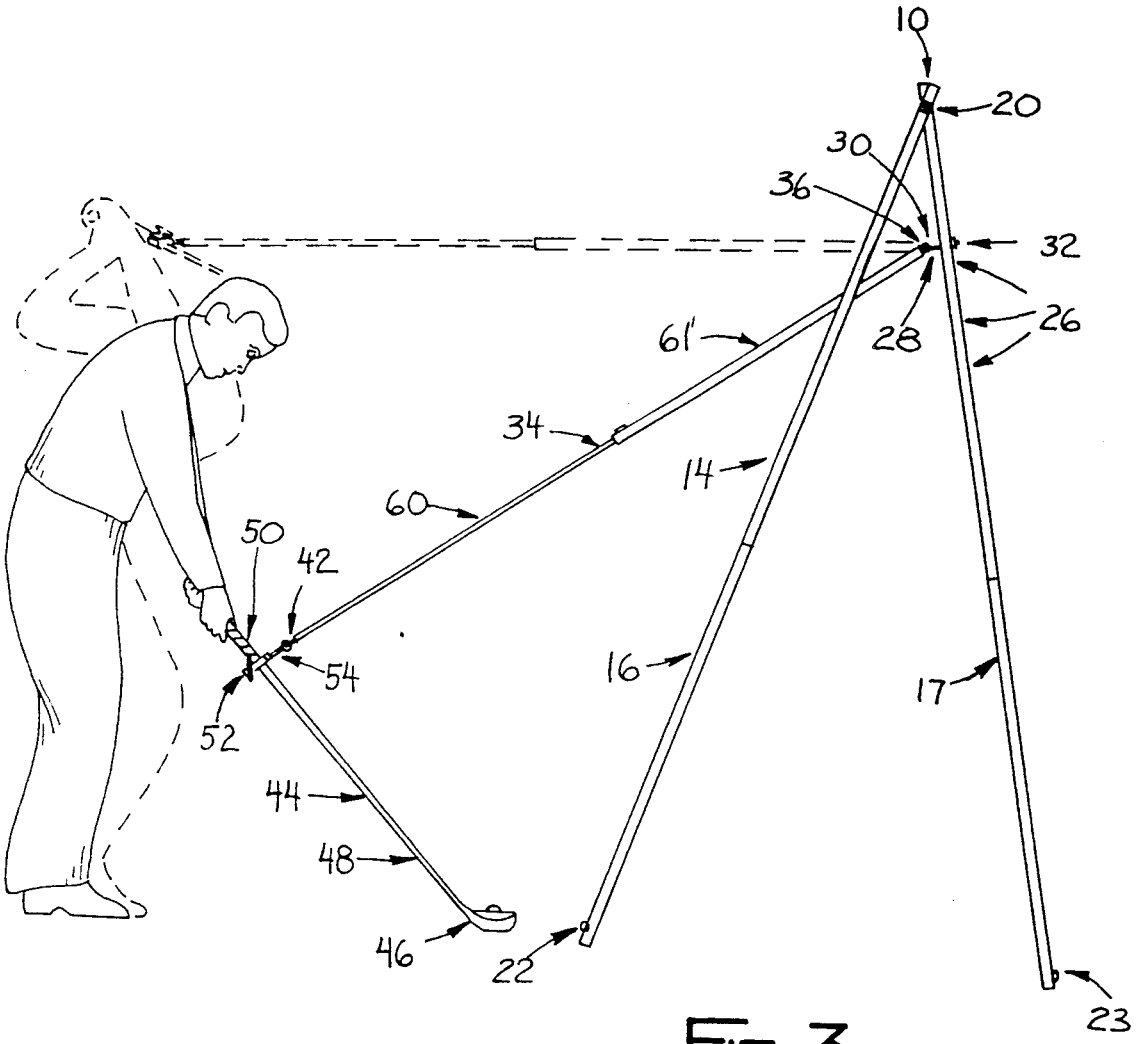
FIG. 3 is an elevation view similar to FOG. 1 and further illustrating the golfer's position at the top of the backswing in broken line form.
Figure 4:
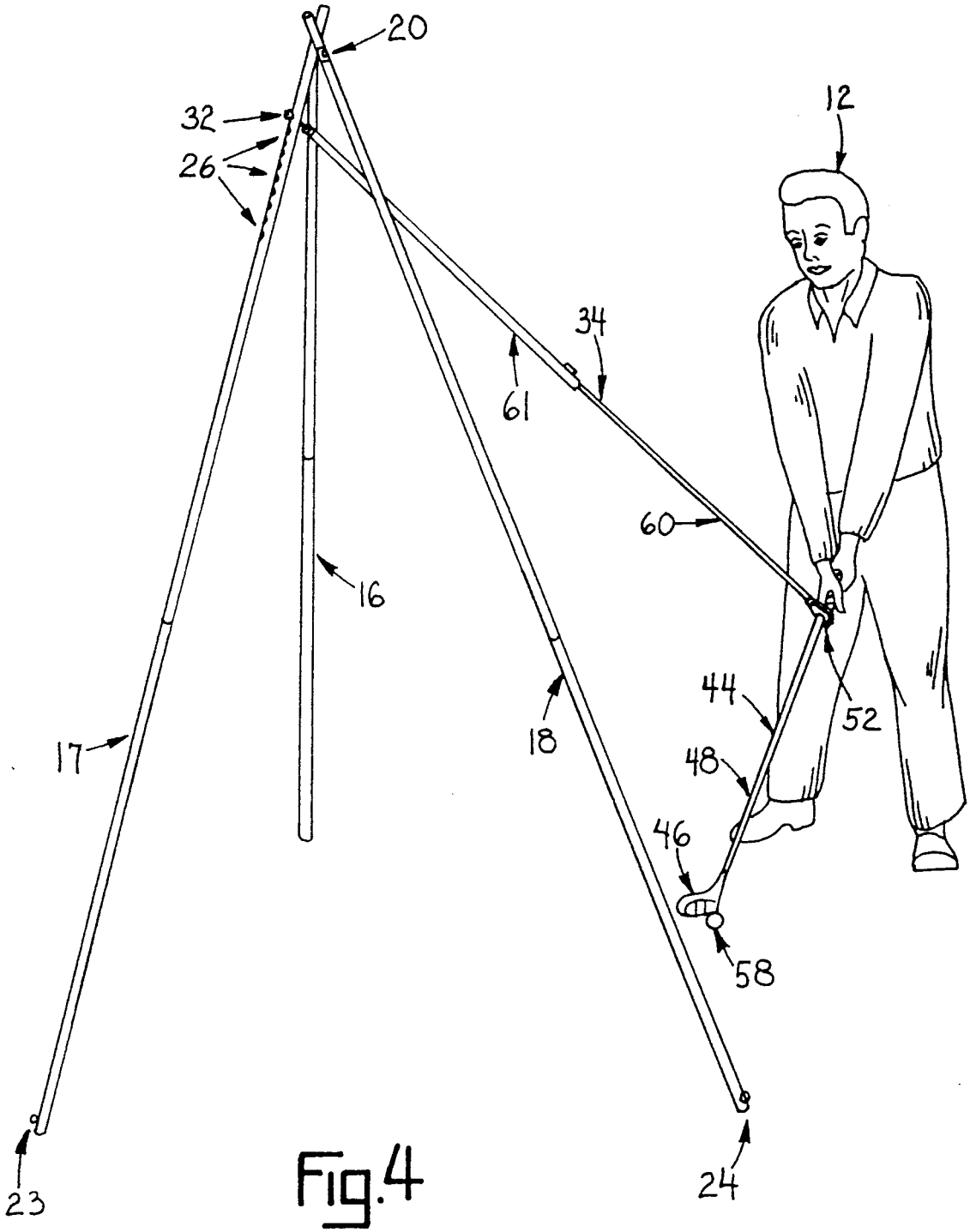
FIG. 4 is a perspective view of the device in the set-up position.
Figure 5:
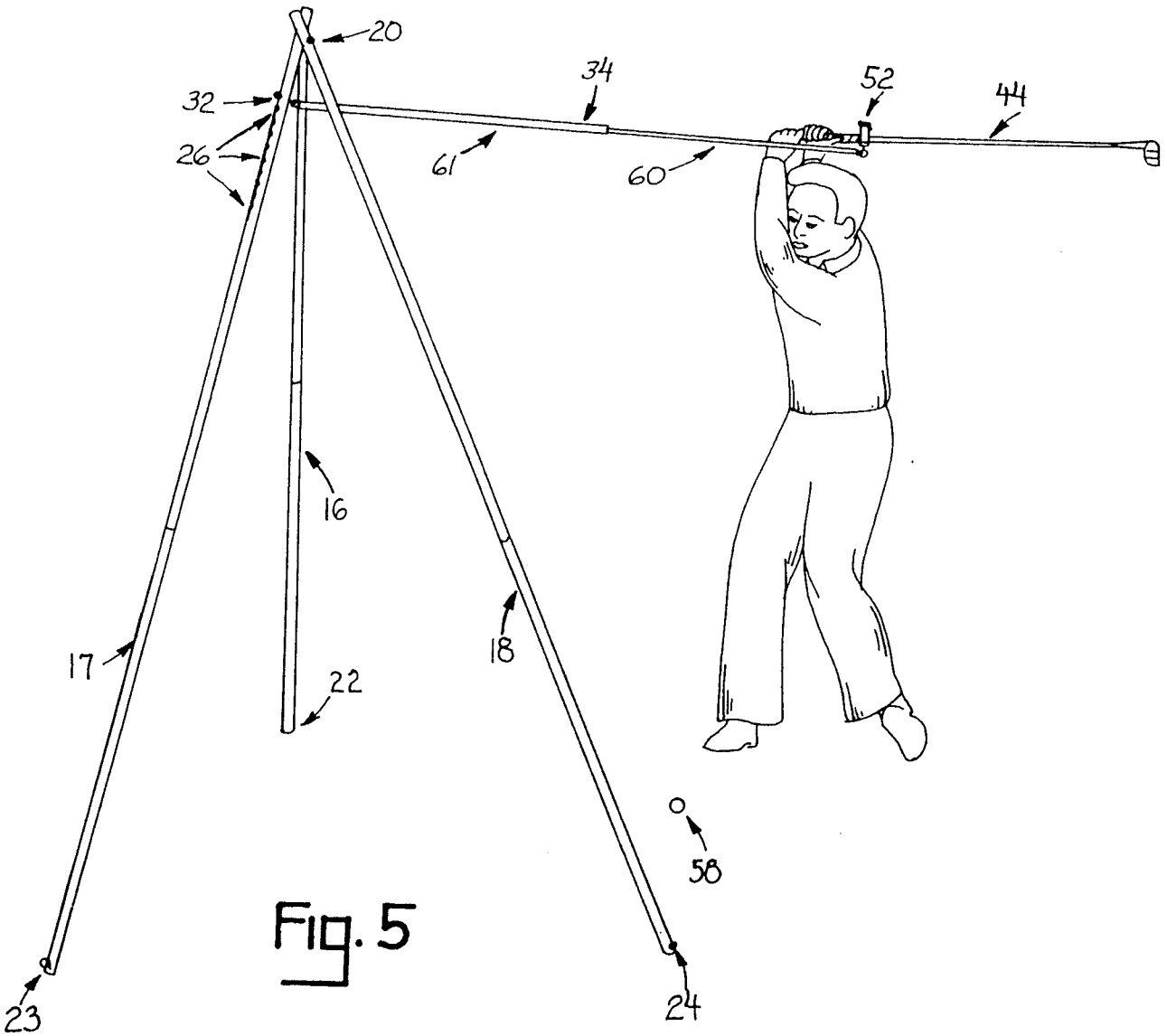
FIG. 5 is a perspective view of the device illustrating the golfer's position at the top of the backswing.
Figure 7:
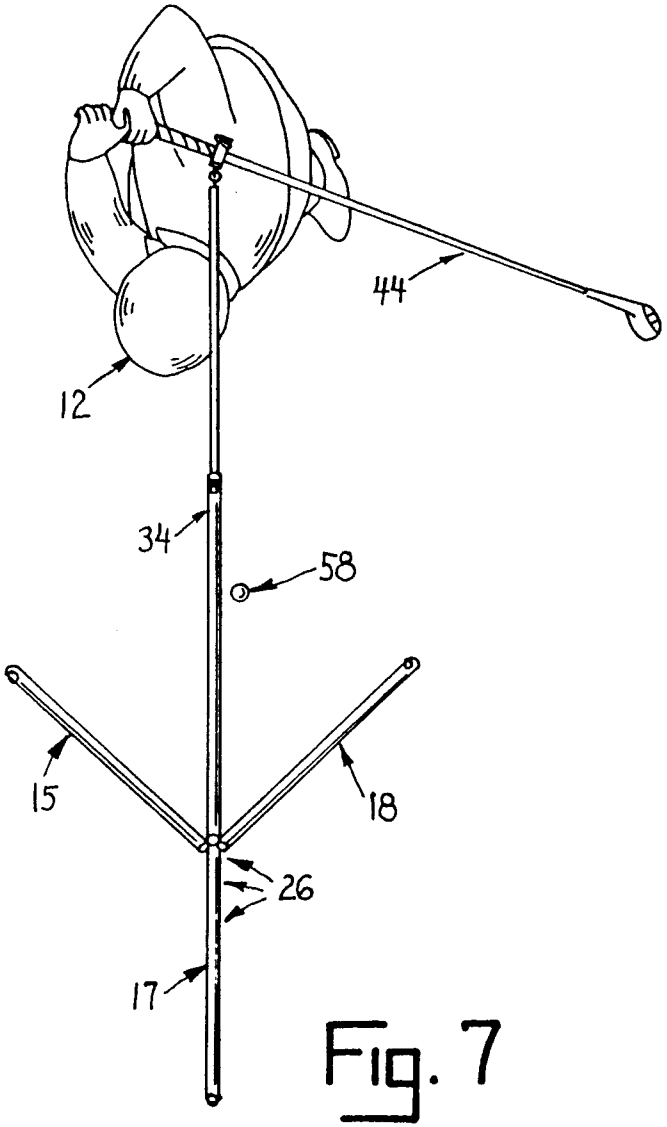
FIG. 7 is a top plan view of the device of FIG. 5.
Figure 6:
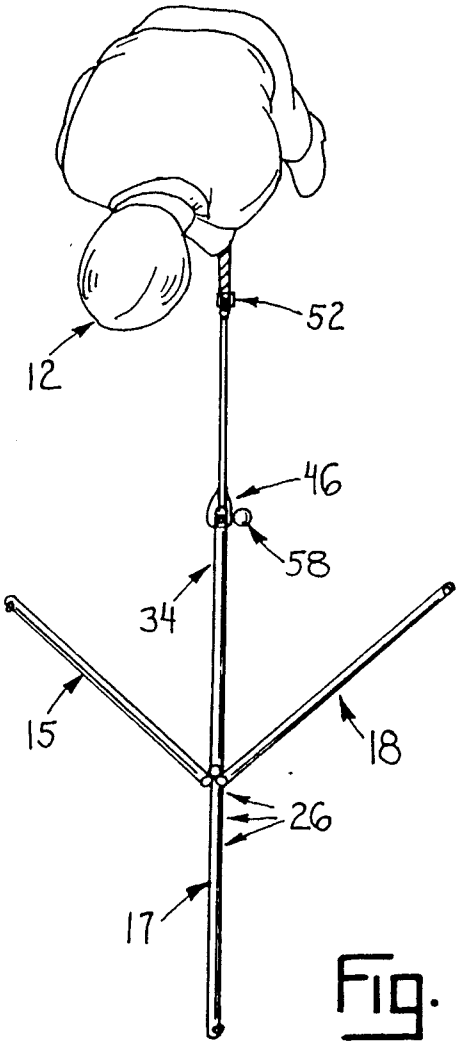
FIG. 6 is a top plan view of the device of FIG. 4.

The preferred embodiment herein described is not intended to be exhaustive or to limit the invention to the precise form disclosed. It is chosen and described to illustrate the principles of the invention and its application and practical us to enable others skilled in the art to use its teachings.

Referring now to FIGS. 1–7 and 12, reference numeral 10 generally designates the swing training device of this invention. Device 10 is generally adapted for use by a golfer 12 to assist in repeated practice of the motions of a correct, fundamentally sound golf swing.

Figure 8:
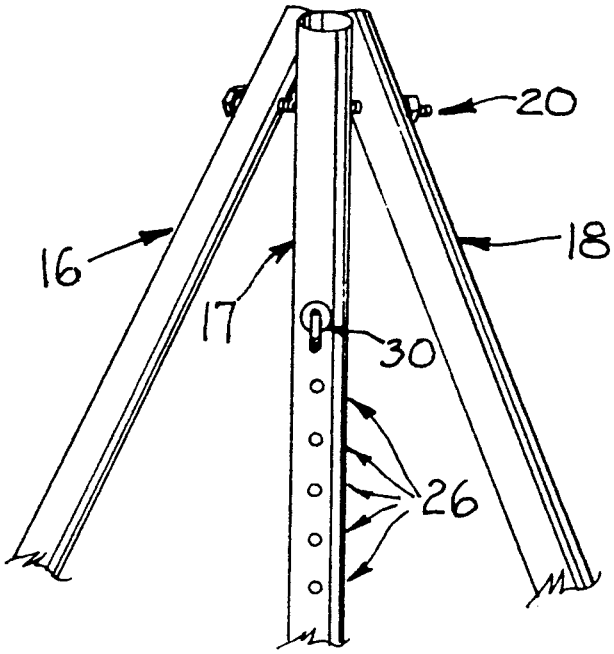
FIG. 8 is a fragmented detail view of the upper section of the frame posts.

Device 10 includes generally a frame 14, shown as three upright posts 16, 17, and 18. Posts 16–18 are arranged in a generally tripodal configuration as shown and are preferably connected at their upper edges as by screw 20 (see FIG. 8). The lower edges of posts 16–18 are preferably anchored in the ground as by stakes 22, 23, 24. So constructed, frame 14 is of a free-standing, self-supportive, and rigid nature.

Post 17 defines a plurality of vertically spaced holes 26 as shown. Bolt 28, which terminates in hook 30 is fitted through one of holes 26 and is detachably secured to the post 17 as by a nut 32. A telescoping shaft 34 is removably connected to hook 30 as by eyelet 36. Shaft 34 as shown consists of two hollow tubes 60 and 61 of a rigid, lightweight, durable material such as aluminum, fibreglass, or the like. Tube 60 is designed to slide freely with respect to tube 61.

Figure 10:
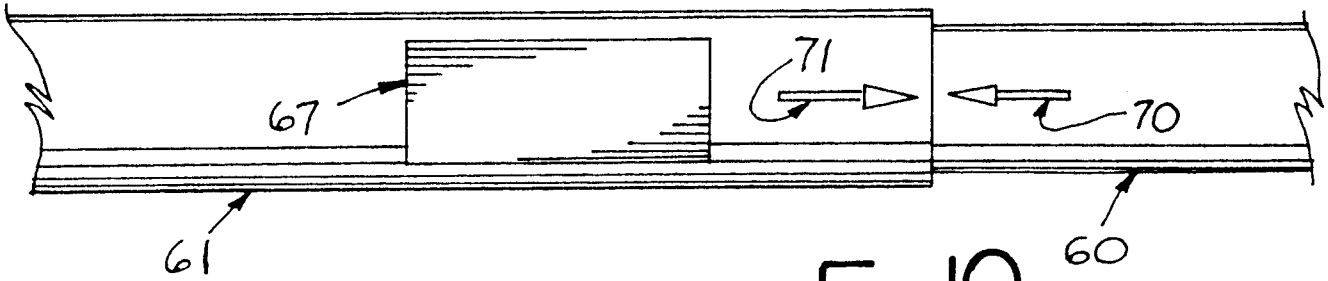
FIG. 10 is an fragmented detail view of the telescoping shaft and its connectors.
Figure 11:
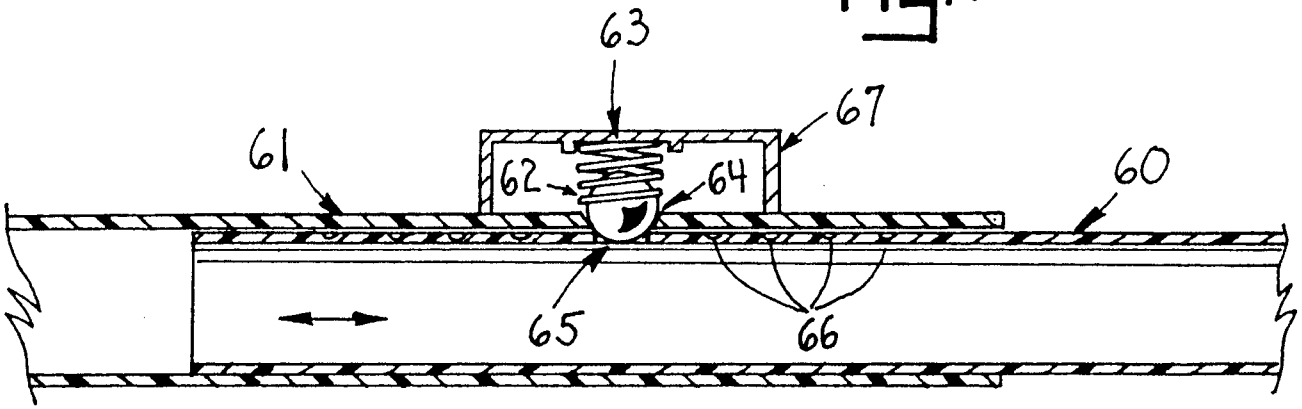
FIG. 11 is a fragmented cross-sectional view of the telescoping shaft including the spring and ball.

FIG. 11 illustrates the audible swing plane indicator in detail. As shown, tube 61 has a bevelled hole 64 and tube 60 has a bevelled hole 65 which is radially alignable with hole 64. Ball 62 is seated in holes 64, 65 and is fixed relative to tube 61 by a housing 67 connected thereto. Spring 63 seats against housing 67 and ball 62 as shown and urges ball 62 downwardly into hole 64. In use, ball 62 will preferably seat in aligned holes 64, 65 as shown in FIG. 11. Tube 60 has a plurality of circumferential spaced grooves 66 defined in its outer surface as shown. Arrows 70,71 imprinted or embossed on tubes 60, 61 serve to visually aid the golfer in proper seating of ball 62 (see FIG. 10).

Shaft 34 has eyelet 36 on one end, and a swivel connector 54 and clamp 52 on the other end. Eyelet 36 serves to connect the shaft 34 to frame 14 by hook 30, and clamp 52 serves to connect shaft 34 to the golfer's club 44. Swivel 54 serves to allow shaft 34 to revolve and rotate freely without permitting shaft 34 to apply torque, or couple, to club 44.

Figure 9:
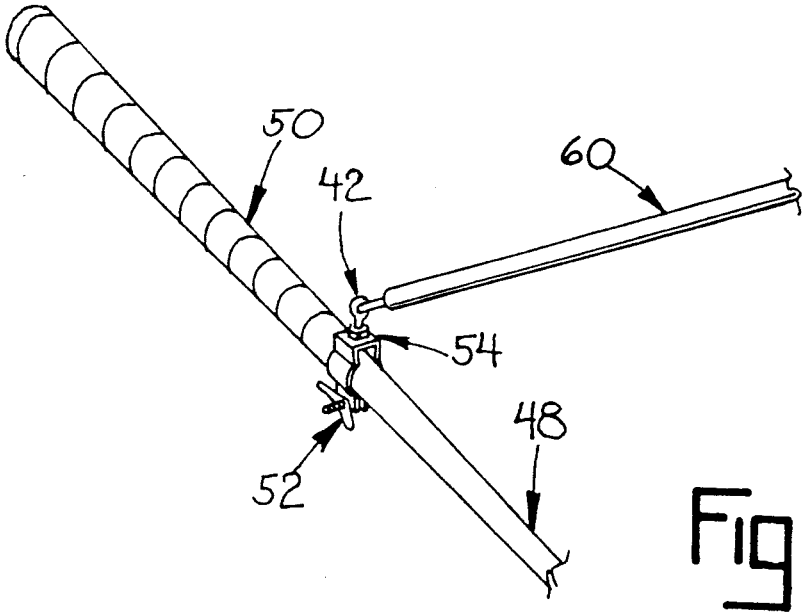
FIG. 9 is a fragmented detail view of the connection of the telescoping shaft to the golf club.

FIG. 9 illustrates the connection of shaft 34 to club 44. Club 44 includes conventionally a club head 46, a shaft 48, and a grip 50. Clamp 52 is secured to club shaft 48 just below grip 50 as shown. A common swivel connector 54 connects eyelet 42 to clamp 52 as shown.

FIGS. 1-7 and 12 illustrate the manner of use of device 10 by golfer 12.

FIG. 1 illustrates a typical address position. Golfer 12 positions himself over the ball 58 as desired and grips club 44 so that shaft 34 does not exert a great deal of force on frame 14. Golfer 12 then swings the club 44 back in a normal fashion, with the top of the backswing shown in dotted lines in FIG. 3 and in solid lines in FIGS. 5 and 7. Since the backswing is best accomplished with the golfer's hands following a generally circular arc, the length of shaft 34 remains constant throughout the backswing.

Figure 12:
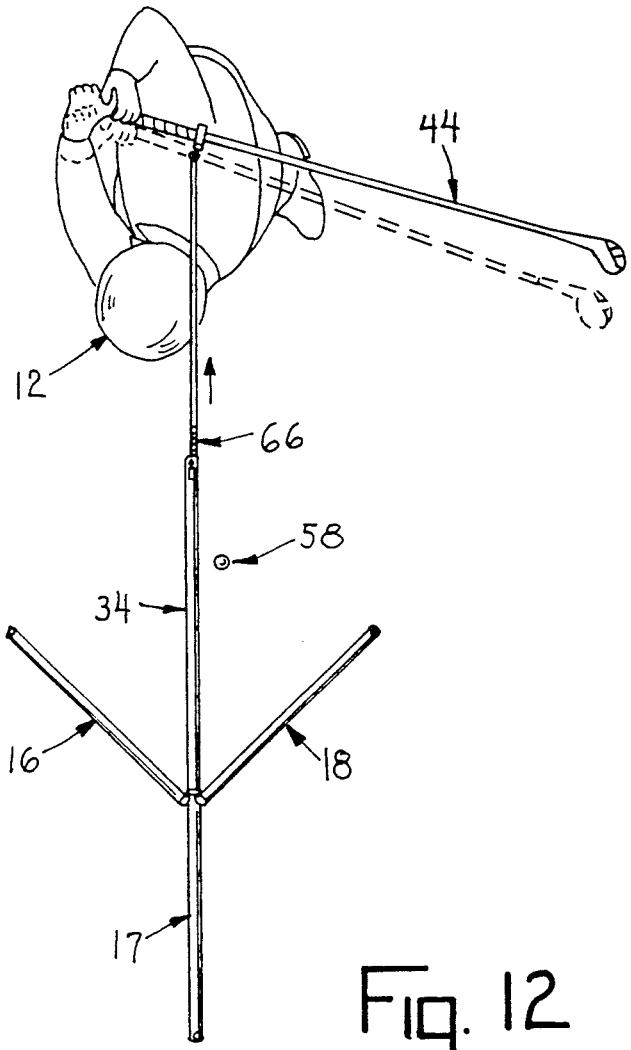
FIG. 12 is a top plan view of the device of FIG. 5 showing the telescoping shaft elongated by a deviant backswing, with the correct backswing shown in broken line form.
Figure 13:
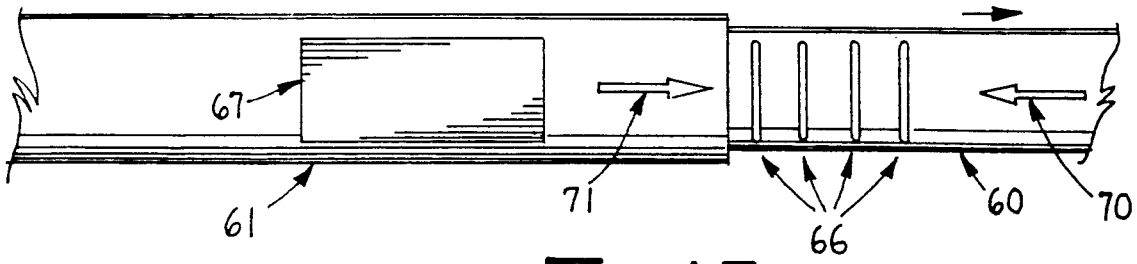
FIG. 13 is a fragmented detail view of the telescoping shaft in an elongated position.

If the golfer's hands deviate from this true arc during the backswing, axial force on the shaft 34 increases. When this force exceeds the predetermined threshold force of spring 63 (preferably only a few ounces), ball 62 will be unseated from hole 65, permitting shaft 34 to lengthen or shorten. As the tubes 60, 61 move relative to each other, ball 62 rides across circumferential grooves 66, generating an audible signal of a deviant backswing to golfer 12. By following the proper arc, the golfer 12 is able to complete a full backswing with no change in length of shaft 34. FIG. 12 shows the golfer having taken a deviant backswing and lengthened the telescoping shaft, with the position of a correct backswing shown in broken line form.

The shaft 34 shortens during a proper "in-plane" downswing, resulting in the audible signal. Thus, the golfer 12 must be instructed to swing the golf club 44 to the top of the backswing (FIG. 3, 5, and 7) with no audible signal from the shaft 34, and to swing down towards the ball in such a manner as to shorten the shaft, thus generating the audible signal on the downswing. The muscle memory acquired during practice will greatly assist the golfer in efforts to duplicate this correct, fundamentally proper swing during actual play. The acquisition of this muscle memory is facilitated by the placement of the clamp 52 immediately adjacent the hands of golfer 12 on shaft 48. The closer the clamp is to the hands, the more the force from shaft 34 is transmitted directly to the golfer's hands, thus improving his ability to feel the effect of shaft 34 on the club, and thus training his muscles with a more easily felt guidance into the proper swing plane.

By selective placing of bolt 28 in one of the vertically spaced holes 26 of post 16, golfer 12 can quickly and easily select the swing plane with the ideal angle of inclination for his particular height and physique. In general, taller golfers will produce a more upright swing plane as shown in FIG. 1 and 3-7, while shorter golfer 13 (FIG. 2) will require a flatter plane, although there are numerous exceptions to this rule. Individual golfers can select the angle of inclination desired by moving bolt 28.

Disassembly of device 10 is facilitated by the construction shown. When finished with a practice session, golfer 12 removes stakes 22-24 and gathers posts 16-18 for storage with shaft 34 after removing clamp 52 from club shaft 48. For ease of storage, posts 16-18 may each be formed of two or more detachable tubes in order to minimize storage size.

It is understood that the above description does not limit the invention to the details given, but may be modified within the scope of the following claims.

I claim:

1. A golf practice device comprising a frame, said frame including a post, means for fastening said post at one end thereof to a surface, a shaft, means connecting said shaft at a first terminal end to said post, said shaft having a second terminal end, means connecting said shaft at said second terminal end to a golf club, said shaft including first and second interconnected tubes slidable relative to each other, means carried by one of said first and second tubes for generating an audible signal upon relative sliding movement of one of the tubes.

2. The golf practice device of claim 1 wherein said first and second tubes are telescoping and define alignable holes, said means for generating including a ball seated in said alignable holes, a circumferential groove defined in one of said tubes adjacent said alignable holes.

3. The golf practice device of claim 2 and biasing means for urging said ball into said holes and to secure said first and second tube against relative movement.

4. The golf practice device of claim 3 wherein said biasing means includes a housing, and a helical spring bearing on said housing and said ball, said spring of a predetermined load to allow unseating of the ball out of one of said holes upon application of axial force greater than said predetermined load.

5. The golf practice device of claim 2 and a plurality of said grooves defined in one of said tubes on either side of said alignable holes.

6. The golf practice device of claim 2 and indicator means carried by said tubes for properly positioning said ball in said alignable holes.

7. The golf practice device of claim 1 wherein said post defines a plurality of vertically spaced holes, a fastener removably extending through a selected one of said holes, and hook means associated with said shaft and fastener for connecting the shaft and the fastener.

8. The golf practice device of claim 1 wherein said means for connecting includes a clamp removably attached to the shaft of said golf club adjacent to a golf club grip, and a swivel connector between said grip and said shaft.

9. The golf practice device of claim wherein said frame includes three of said upright posts arranged in tripod fashion, means for detachably connecting said posts adjacent a top edge thereof.

* * * * *